United States Patent [19]

Armstrong

[11] Patent Number: 4,571,698

[45] Date of Patent: Feb. 18, 1986

[54] APPARATUS AND SYSTEM FOR REMOTE TIMING OF PLURAL ENTITIES

[76] Inventor: Orin R. Armstrong, 2013 N. Potomac St., Arlington, Va. 22205

[21] Appl. No.: 444,950

[22] Filed: Nov. 29, 1982

[51] Int. Cl.[4] ..... G04F 10/00

[52] U.S. Cl. ..... 364/569; 368/2; 368/111; 368/155

[58] Field of Search ..... 368/2, 118, 111, 1, 368/278, 155; 377/4; 364/569, 705, 709, 704

[56] References Cited

U.S. PATENT DOCUMENTS 4,245,334 11/1981 Bieramperl ..... 368/2

4,367,051 11/1983 Inoue ..... 368/2

4,376,995 3/1983 Shimizu ..... 368/155

*Primary Examiner*—Gary Chin

*Attorney, Agent, or Firm*—Millen & White

[57] ABSTRACT

A system and method for timing a plurality of entities, typically marathon runners over a premeasured course including a first transmitter at the starting line for transmitting a predetermined type signal. Each runner carries a timing unit actuable upon passing within a predetermined distance of the first transmitter. At another location is a second transmitter and as each runner passes within a predetermined distance the respective timing units are stopped. A read-out means is provided for having each timing unit connected thereto at the end of the event for obtaining the time elapsed.

4 Claims, 4 Drawing Figures

APPARATUS AND SYSTEM FOR REMOTE TIMING OF PLURAL ENTITIES

BACKGROUND OF THE INVENTION

This invention relates to a time-measuring and indicating apparatus, and to a system and method for measuring, recording and comparing the elapsed time required to complete an event or function for each of a plurality of moving entities.

U.S. Pat. No. 4,142,680 describes a system for indicating the elapsed time from a start point of each of a plurality of entities, such as race horses, to the end of the course. A plurality of radio frequency transmitters, each carried by respective entities, emanate a radio frequency signal discrete to that entity. A timing counter receives the signals, and by the particular frequency received identifies the entity and transmits the information to be printed out for obtaining the times of the racing entities.

U.S. Pat. No. 3,434,712 teaches a timing apparatus having a timing portion which is connected to an indicating portion which can be a display. The display can be connected to a printer/recorder for printing out information.

U.S. Pat. No. 4,245,334 teaches a self-contained device for measuring and indicating the time between the reception of first and second airborne signals. This device carries a timer and display on a single unit and is designed to indicate elapsed time to a single entity as directly as possible.

The only device discussed above designed to indicate elapsed time from the beginning of an event to the end of the event to a plurality of entities is U.S. Pat. No. 4,142,680. This system, however, has a number of disadvantages in that it is very complicated and difficult to operate. Moreover, the number of entities is limited by the presently limited number of frequencies which can be employed and serious problems are presented, especially when timing from one specific location to another location.

On the other hand, U.S. Pat. No. 4,245,334 teaches a simple unit for timing an event of a single entity and displaying elapsed time directly to the entity. However, it is impossible to adapt this device to timing a plurality of entities simultaneously.

SUMMARY OF THE INVENTION

It is thus an object of the present invention to provide a simple and economical system for timing the time of an event for a plurality of different entities.

It is also an object of the invention to provide a simple and rapid method of identifying each of a plurality of entities, determining the elapsed time required by each to complete an event or function, and arranging the elapsed time of each of the entities in numerical order.

Still another object of the invention is to provide a system and method for identifying a plurality of runners, determining their time over a premeasured course, and arranging the order of finish in accordance with their time over a premeasured course and arranging the order of finish in accordance with their times.

Upon further study of the specification and appended claims, further objects and advantages of this invention will become apparent to those skilled in the art.

In accordance with the invention the system comprises a first transmitter located at a first location and adapted for transmitting a first airborne signal. A second transmitter is located at a second location and is adapted for transmitting a second airborne signal. A plurality of timing units made up of an electronic stopwatch for delivering clock signals upon activation thereof, a memory coupled to the watch for receiving and storing the clock signals, receiving means for receiving the first and second signals and adapted for starting and stopping the stopwatch respectively upon receipt of the first signal and then the second signal, and a means for outputting the elapsed time clocked by the stopwatch and stored in the memory. There is also provided separately computing means to which each of the timing units can be connected at the end of the timed event to display and record the elapsed time recorded by each unit. Preferably, the computing means is adapted for arranging and printing out in sequential order the times recorded the units, and for identifying the entity associated with each timing unit so that the order of finish by time and identity of the entities can be determined.

In another aspect, the invention comprises a method for indicating elapsed time in order of finish for each of a plurality of entities. Each entity carries a timing unit of the type discussed above, and when the individual entities pass within range of transmission of the first airborne signal transmitting means, the stopwatch in its timing unit is started. Upon passing within range of transmission of the second airborne signal transmitting means, the stopwatch in the respective timing unit is stopped. Each timing unit having identifying means, is then plugged into a computing means whereupon the elapsed time stored in the memory of each of said units is transferred to the computing means for at least one of display, recording and arranging in increasing and/or decreasing numerical order.

BRIEF DESCRIPTION OF THE DRAWINGS

Various other objects, features and attendant advantages of the present invention will be more fully appreciated as the same become better understood when considered in conjunction with the accompanying drawings, in which like reference characters designate the same or similar parts throughout the several views, and wherein.

DETAILED DISCUSSION OF THE INVENTION

Figure 1:
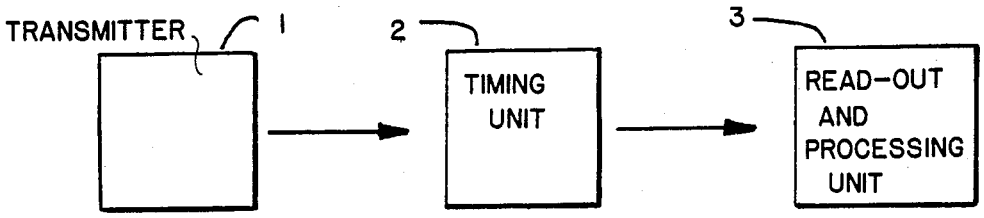
FIG. 1 is a block diagram of the complete system of the invention.
Figure 2:
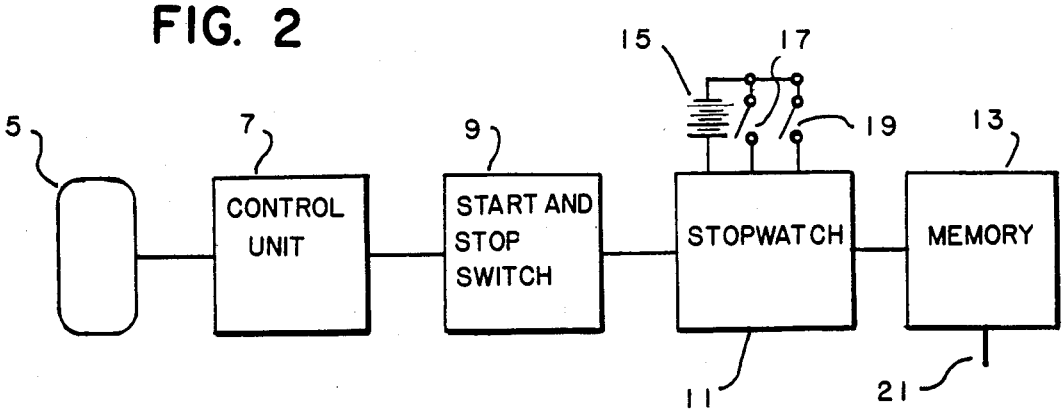
FIG. 2 is a block diagram illustrating the timing unit employed in the system.
Figure 3:
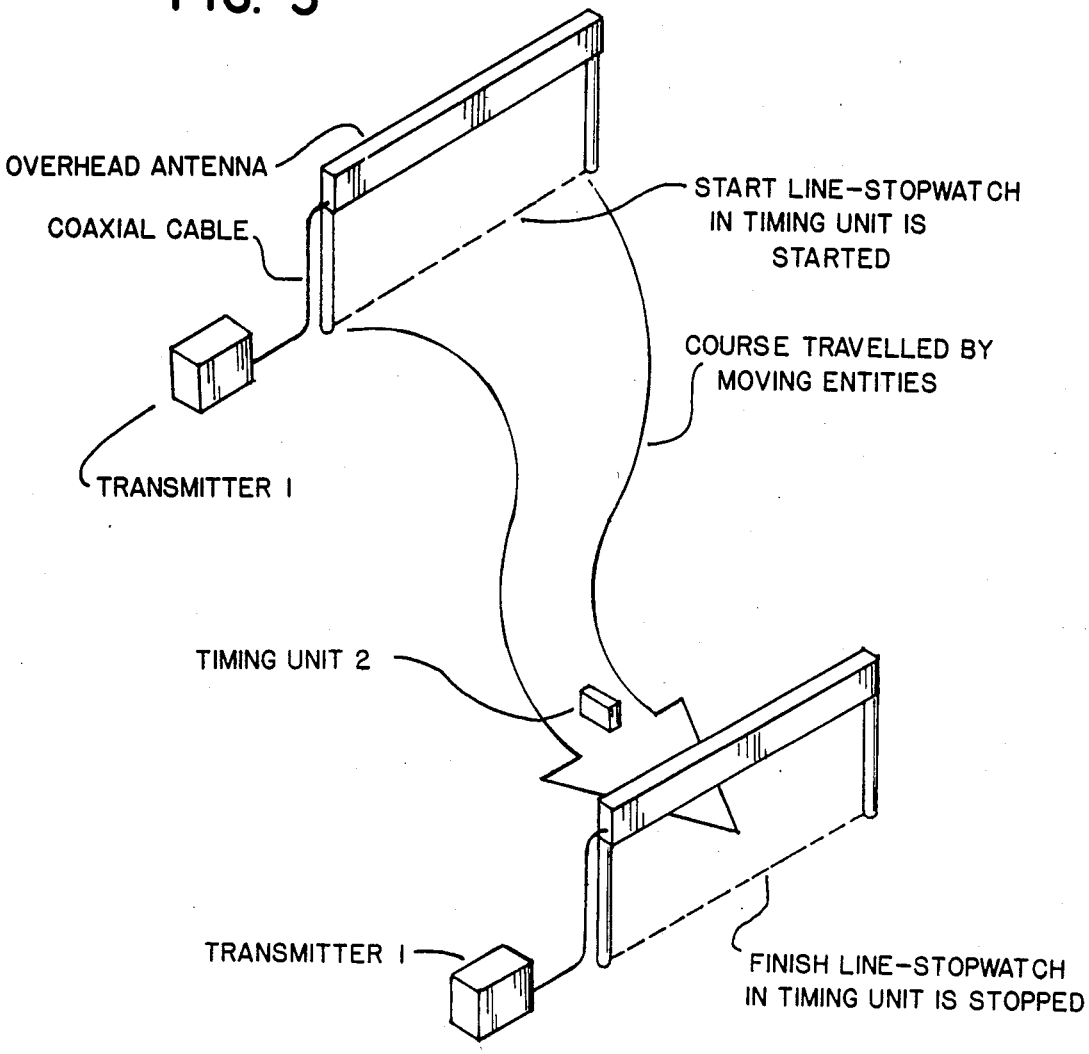
FIG. 3 is a schematic diagram showing how the airborne signal transmitters and the timing units would interact for recording elapsed time over a course.

In FIG. 1 there is illustrated one embodiment of the timing system according to the invention. An airborne signal transmitter 1 is provided for starting and stopping a portable timing unit 2 by means of airborne signals, typically encoded radiation. Although it is preferred that the signals transmitted by the transmitter 1 be radio frequency, i.e., rf radiation, either amplitude or frequency modulated, other type airborne signals will suffice as will be well known to those skilled in the art. The rf radiation would, for example, be transmitted by a narrow beam antenna, as will be discussed hereinafter.

The signals employed can also, for instance, be acoustical signals, in which case the receiver therefor would be an acoustic transducer. Furthermore, the transmitter 1 is designed to have a limited range so that the timing unit 2 is not activated unless it is passed through the limited range of the transmitter 1, for example, a starting gate.

The timing unit 2 is designed to be very small, light and portable, so as to be easily carried or worn by a person, for example, a runner competing in a marathon race.

The timing unit 2 includes a receiving sensor 5 for airborne signals, typically an antenna for rf signals of the type discussed above. Connected to the sensor 5 is a control unit which is responsive to the signal received, and depending on the state of a start and stop switch 9 connected thereto, either starts or stops the operation of a timing unit, i.e., stopwatch 11. The sensor 5, control unit 7, and start and stop switch 9 are all conventional, and can be modified readily in accordance with the particular signal employed to activate or deactivate the stopwatch 11.

As can be seen from the drawing, the stopwatch 11 is powered by a battery 15, and a reset switch 19 and a master power switch 17 are provided for, respectively, resetting the watch 15 for subsequent operations, and providing power for operation of the device.

The stopwatch unit is conventional, preferably of an IC type. One such device capable of being employed in the present invention is, for instance, a 555 timer such as disclosed in the text *Electronic Circuits, Discrete and Integrated,* by Schilling and Belove, McGraw Hill, 1979, pgs. 727–728 and Appendix C 4-7 thereof. Such a device is presently manufactured by Motorola, identified as the MC 1455 and 1555 series of timing circuits, and available in a number of IC package cases.

The stopwatch 11 is also coupled to a memory 13, also conventional in nature, for storing elapsed time therein. The stopwatch 11 preferably does not include a read-out.

At the end of a race, the stopwatch 11 having been stopped and the elapsed time stored in memory 13, the timing unit 2 is coupled through output 21 to computing means, i.e., a read-out and/or processing unit 3. More particularly, the read-out device 3 preferably incorporates a time display panel, such as an LED display, to reveal the elapsed time stored in memory 13 of the timing unit 2.

Each timing unit includes in memory a permanent identifying code which is provided to the read-out device 3 so that each entity can be specifically identified and the order of finish and corresponding times arranged in sequence.

Likewise, the read-out and processing unit 3 can also comprise a complicated computer system designed to do multiple operations with the information supplied thereto by each timing unit. The computer system design to be employed is conventional and well known to those skilled in the art and can be adapted for specific data manipulation as necessary.

The actual physical embodiment of the timing unit is such that it is about the size of a small digital watch and can be strapped to a wrist or ankle, worn about the neck on a lanyard, or pinned or clipped to the runner's clothing.

Referring again to the transmitter 1, in a preferred embodiment, the transmitter 1 will comprise a low-power transmitter equipped with one or two transmitting antennas, as the case may require, in the form of a partially-shielded cable mounted above the start/finish line of a race. The partially-shielded cable will ensure that the frequency is transmitted downwards and forwards only. The power output required is low, only sufficient to turn on and off the timing units 2 passing within a few feet of the transmitter's antenna.

In one method of using the system, runners, each carrying a timing unit 2 pass under the transmitter 1 transmitting the start frequency, and each runner's stopwatch 11 begins to count. The distance between the "start" and the "stop" antenna is the measured distance of the race, and as each runner passes under the finish or "stop" antenna, his timing unit 2 stops counting. The runner then proceeds to the location of the read-out unit 3, and his timing unit 2 is plugged into the read-out unit 3 to obtain his time for the race and a record thereof is then made. Additionally, the read-out unit 3 compares his elapsed time to the elapsed time recorded by all of the other runners' timing units 2, and arranges all of such elapsed times in ascending order, identifying the runner who achieved each time.

Figure 4:
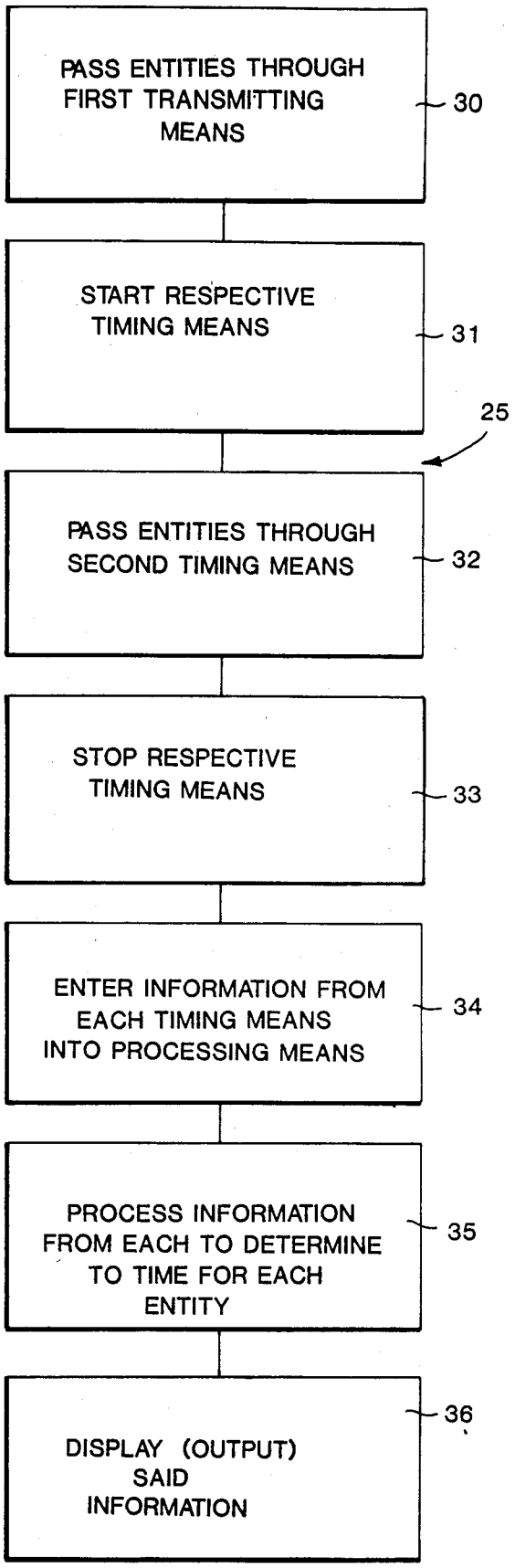
FIG. 4 is a flow chart illustrating the method of the instant invention.

Referring now to FIG. 4 wherein a flow chart, designated generally by the numerals 25, sets forth the method of the invention, the timing process begins as the entities pass through the first transmitting means 30 which starts the timing means 31. When the entities pass through the second timing means 32 the timing means is stopped at 33. The information from each timing means is entered at 34, processed at 35 and displayed at 36.

Other uses for the system according to the invention are contemplated. For instance, in nuclear power plants it may be desirable to time the amount of time a worker spends in a particular chamber. Thus, the stopwatch would be started and stopped as a worker passed through a door into and out of a specific room. At the end of the day, the worker would report to a read-out station, at which his total time of exposure would be determined. Likewise, the system could be adapted for horse races or the like where elapsed time would be measured. Other equivalent uses can be ascertained.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method for timing the elapsed time of an event for a plurality of entities by using a system comprised of first transmitting means located at a first location for transmitting a first activating signal within a predetermined limited distance, second transmitting means located at a second location for transmitting a second activating signal within a predetermined limited distance, a plurality of timing means for being carried respectively by individual ones of a plurality of entities, each timing means consisting essentially of stopwatch means for timing the start and finish of an event, receiving means for receiving said first and second activating signals from said first and second transmitting means for respectively starting and stopping said stopwatch means, and memory means for storing the time clocked by said stopwatch means, said memory means having an output, and the system further comprising read-out and processing means separate from said plurality of timing means for having each one of said timing means individually connected thereto at said memory means output for providing a read-out of the time stored in said memory means of the individual timing means, and for further processing of the elapsed times, the method comprising the steps of arranging the entities, each carrying a respective timing means, near said first transmitting means; passing each of said entities within the predetermined transmitting range of said first transmitting means thereby starting operation of said respective timing means in a counting mode; passing each of said entities, at the end of the event, within the predetermined transmitting range of said second transmitting means to thereby stop the counting operation of said respective timing means and causing the count of each timing means to be stored in the respective memory means thereof; individually connecting each of the said timing means to said read-out and processing means and transferring the stored count for each individual entity into the read-out and processing means; converting the transferred counts to an elapsed time value for each timing means; and displaying the elapsed time values for each timing means.

2. A method as in claim 1, wherein said event timed for each entity is a race over a course wherein the first transmitting means is positioned at the start of the race course, the second transmitting means is positioned at the end of the race course, and further comprising passing all said entities through the start of the race course, over the course, and past the end of the race course to cause the respective timing means to record the time of the respective entities.

3. A method as in claim 1, further comprising transferring from memory, with the count, an identifying code for each timing means, to said read-out and processing means to thereby correlate and match the transferred count with the respective entities.

4. A method as in claim 1, comprising conducting said method in a nuclear plant to determine the time a worker spends in predetermined rooms.

* * * * *